US012139291B2

(12) United States Patent
Ruers et al.

(10) Patent No.: US 12,139,291 B2
(45) **Date of Patent: *Nov. 12, 2024**

(54) PROCESS FOR FORMING A HOOD FOR A TRAY

(71) Applicant: The Procter & Gamble Company, Cincinnati, OH (US)

(72) Inventors: Henri Theo Leonie Ruers, Antwerp (BE); Andrea Ziantoni Liberatori, La Hulpe (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/506,351

(22) Filed: Nov. 10, 2023

(65) Prior Publication Data

US 2024/0076074 A1 Mar. 7, 2024

Related U.S. Application Data

(63) Continuation of application No. 18/096,172, filed on Jan. 12, 2023, now Pat. No. 11,851,232.

(Continued)

(51) Int. Cl.
*B65B 7/28* (2006.01)
*B65B 7/01* (2006.01)

(52) U.S. Cl.
CPC . *B65B 7/01* (2013.01); *B65B 7/28* (2013.01)

(58) Field of Classification Search
CPC ..... B65B 7/28; B65B 7/01; B65B 7/2807; B65B 7/2842; B65B 5/024; B65B 43/10;

(Continued)

(56) References Cited

U.S. PATENT DOCUMENTS 3,366,496 A 1/1968 Bomar et al.
4,420,924 A * 12/1983 Hoyrup ..... B65B 7/2807 53/307

(Continued)

FOREIGN PATENT DOCUMENTS

EP 0074673 A1 3/1983
EP 3587293 A1 1/2020

(Continued)

OTHER PUBLICATIONS

Extended EP Search Report and Search Opinion for 22213141.9 dated Aug. 4, 2023, 6 pages.

(Continued)

*Primary Examiner* — Andrew M Tecco
(74) *Attorney, Agent, or Firm* — Gary Joseph Foose; George H. Leal

(57) ABSTRACT

A process for packaging a product in which a hood is fitted to a tray. The hood is erected by a process that includes a step of providing a flat blank. The flat blank includes a leading panel and a trailing panel. A flat insert is provided and adhered to a panel selected from the group of the leading panel, the trailing panel of the hood, and combinations thereof. The die used to erect the hood includes a die recess. When the die is positioned within the mold, the central portion of the flat insert becomes spaced apart from the hood top. The die recess provides for space to accommodate the central portion of the flat insert becoming spaced apart from the hood top.

19 Claims, 9 Drawing Sheets

Related U.S. Application Data

(60) Provisional application No. 63/299,582, filed on Jan. 14, 2022.

(58) Field of Classification Search
CPC ... B65B 1/02; B31B 2110/35; B31B 2120/10; B31B 50/0044; B31B 50/52
See application file for complete search history.

(56) References Cited

U.S. PATENT DOCUMENTS

| | | | | |
|---|---|---|---|---|
| 5,450,998 | A * | 9/1995 | Esse | B65D 5/32 229/122.34 |
| 5,494,161 | A | 2/1996 | Herbst | |
| 5,505,374 | A | 4/1996 | Stone | |
| 5,725,144 | A | 3/1998 | Stone et al. | |
| 6,484,478 | B1 | 11/2002 | Arends et al. | |
| 6,484,479 | B1 * | 11/2002 | Minion | B65B 43/265 53/565 |
| 6,604,676 | B2 | 8/2003 | Giblin | |
| 8,596,520 | B2 | 12/2013 | Scott | |
| 9,783,335 | B2 | 10/2017 | Everett | |
| 9,881,788 | B2 | 1/2018 | Kim et al. | |
| 9,994,355 | B2 * | 6/2018 | Ishikawa | B65D 5/545 |
| 10,017,291 | B2 | 7/2018 | Smith et al. | |
| 10,934,072 | B2 | 3/2021 | Lantz et al. | |
| 11,097,867 | B1 | 8/2021 | Nixon | |
| 11,530,058 | B2 * | 12/2022 | Jonker | B65B 7/2871 |
| 11,667,411 | B2 * | 6/2023 | de Jong | B65B 43/10 53/462 |
| 11,794,947 | B2 | 10/2023 | Hoefte et al. | |
| 11,851,232 | B2 * | 12/2023 | Ruers | B65B 7/2842 |
| 2003/0111523 | A1 | 6/2003 | Haugan | |
| 2013/0193197 | A1 | 8/2013 | Low et al. | |
| 2017/0001752 | A1 * | 1/2017 | Ishikawa | B65D 5/64 |
| 2017/0036808 | A1 | 2/2017 | Everett | |
| 2017/0267398 | A1 | 9/2017 | Couture | |
| 2018/0257827 | A1 | 9/2018 | Drosos et al. | |
| 2019/0062023 | A1 | 2/2019 | Lantz et al. | |
| 2021/0047072 | A1 | 2/2021 | Ng Pak Leung et al. | |
| 2021/0237914 | A1 * | 8/2021 | Jonker | B65B 7/28 |
| 2022/0009671 | A1 | 1/2022 | Hoefte et al. | |
| 2022/0081155 | A1 | 3/2022 | Hoefte et al. | |
| 2022/0185534 | A1 | 6/2022 | Hoefte et al. | |
| 2022/0289436 | A1 | 9/2022 | Hoefte et al. | |
| 2022/0380086 | A1 | 12/2022 | Hoefte et al. | |
| 2023/0103439 | A1 | 4/2023 | Hoefte et al. | |
| 2023/0110630 | A1 * | 4/2023 | Hoefte | B65D 5/443 206/525 |
| 2023/0132541 | A1 | 5/2023 | Hoefte et al. | |
| 2023/0227186 | A1 | 7/2023 | Ruers et al. | |
| 2023/0257141 | A1 | 8/2023 | Ruers et al. | |
| 2023/0257145 | A1 | 8/2023 | Ruers et al. | |
| 2023/0264852 | A1 | 8/2023 | Hoefte et al. | |
| 2023/0264853 | A1 | 8/2023 | Hoefte et al. | |
| 2023/0286695 | A1 | 9/2023 | Hoefte et al. | |
| 2023/0322455 | A1 | 10/2023 | Beelen et al. | |
| 2023/0331447 | A1 | 10/2023 | Hoefte et al. | |
| 2024/0002100 | A1 | 1/2024 | Hoefte et al. | |

FOREIGN PATENT DOCUMENTS

| | | | |
|---|---|---|---|
| EP | 3753856 | A1 | 12/2020 |
| EP | 3936451 | A1 | 1/2022 |
| FR | 2820718 | A1 | 8/2002 |
| IT | BO20100425 | A1 | 12/2011 |
| JP | 4536881 | B2 | 6/2010 |
| WO | 2017033210 | A1 | 3/2017 |
| WO | 2018022493 | A1 | 2/2018 |

OTHER PUBLICATIONS

PCT Search Report and Written Opinion for PCT/US2023/060601 dated Jun. 2, 2023, 11 pages.
All Office Actions; U.S. Appl. No. 18/096,172, filed Jan. 12, 2023.
All Office Actions; U.S. Appl. No. 18/079,929, filed Dec. 13, 2022.
All Office Actions: U.S. Appl. No. 18/079,939, filed Dec. 13, 2022.

* cited by examiner

PROCESS FOR FORMING A HOOD FOR A TRAY

FIELD OF THE INVENTION

Process for forming a hood for a tray.

BACKGROUND OF THE INVENTION

Many products that consumers use on a weekly, or even daily, basis are often sold to consumers in packaging that provides for secure storage. For example water soluble unit dose products are often sold in plastic tubs that have a hinged closure having an opening and closing mechanism that the user manually manipulates to open and close the package. Flexible bags having a tongue in groove locking closure are also commonly used for such products.

Presently, manufacturers of products are intensely focused on sustainable packaging options. Pulp based packaging is garnering particular attention because the recycling stream for such materials is well developed and access thereto is convenient for consumers.

Packages that can be opened and securely closed multiple times can be difficult to fabricate from pulp based materials. Paperboard and corrugate are pulp based materials that show promise for packaging water soluble unit dose products. The rigidity and strength of paperboard and corrugate are a function of many variable, including the thickness of the material. To provide for a package that can be opened and securely closed multiple times, the locking mechanism must be robust. Locking mechanisms used paperboard and corrugate packages commonly employ tabs that fit into slots or panel edges that interfere with movement of flaps. Deformation of the panels, tabs, and flaps can operate to engage and disengage the locking mechanism. Robustness can be provided for by using thick paperboard or corrugate. Of course, increasing the thickness, and thereby weight, of the package per se can have a negative impact on the sustainability of the packaging.

To provide for a robust locking mechanism for packages formed from thin paperboard or corrugate, special attention must be given to the yield stress of the constituent material. The mechanical behavior of paperboard and corrugate below the yield stress is approximately elastic. Mechanisms that operate such the paperboard or corrugate behaves elastically can be robust. When paperboard or corrugate is stressed beyond the yield stress, plastic deformation occurs. For a locking mechanism constructed of paperboard or corrugate, plastic deformation can permanently degrade the function and security of the locking mechanism. As such, designs for locking mechanisms for paperboard and corrugate packages in which the constituent materials operate with elastic behavior are desirable.

With these limitations in mind, there is a continuing unaddressed need for a process for fabricating components of paperboard and corrugate packages that provide for maintaining functionality and security of a locking mechanism for paperboard and corrugate packages.

SUMMARY OF THE INVENTION

A process for packaging a product comprising the steps of: manufacturing the product, wherein said product is a substrate treatment composition; providing a tray carriage system; providing a tray movable in or on said tray carriage system; moving said tray via said tray carriage system in a machine direction; providing a dispensing system above said tray carriage system; dispensing said product into said tray via said dispensing system; providing a hood engagement system above said tray carriage system and downstream of said dispensing system; providing a hood moveable in said hood engagement system, wherein said hood is erected by a process comprising the steps of: providing a flat blank comprising a leading panel, a trailing panel opposite said leading panel, a hood top extending between said leading panel and said trailing panel, a leading fold line between said leading panel and said hood top, a trailing fold line between said trailing panel and said hood top; providing a flat insert adhered to a panel selected from the group of said leading panel, said trailing panel, and combinations thereof, wherein said flat insert has a central portion between said leading fold line and said trailing fold line and wherein said central portion is unattached to said hood top; providing a die comprising a leading edge and trailing edge, a pair of side edges extending from said leading edge to said trailing edge, and a die recess, wherein said die recess is recessed relative to said leading edge, said trailing edge, and said side edges; providing hood mold having a cavity; orienting said flat insert towards said die recess; and positioning said die within said hood mold to fold said flat blank about said leading fold line and said trailing fold line and to fold said flat insert coincidentally with at least one of said leading fold line and said trailing fold line, whereby said central portion is spaced apart from said hood top; engaging said hood with said tray via said hood engagement system to fit said insert within said tray and close said tray to form a closed package; and shipping said closed package.

DETAILED DESCRIPTION OF THE INVENTION

A process for erecting a hood for a tray is described herein. The process can be a part of an end to end process for packaging a product. The product can be any product of the type that can be shipped in a paperboard or corrugate package comprising a tray and a hood telescopically fitted to one another. The product can be a substrate treatment composition. The product can be a substrate treatment composition selected from a laundry treatment composition, a hard surface treatment composition, a laundry washing machine treatment composition, a hair treatment composition, a skin treatment composition, an oral care composition, a cosmetic composition, a nail treatment composition, an air treatment composition, a dish treatment composition, a disposable absorbent article, and a topical or ingested health care composition. The substrate treatment composition can comprise an ingredient selected from a surfactant, a bleach, a fabric softener, and combinations thereof.

Figure 1:
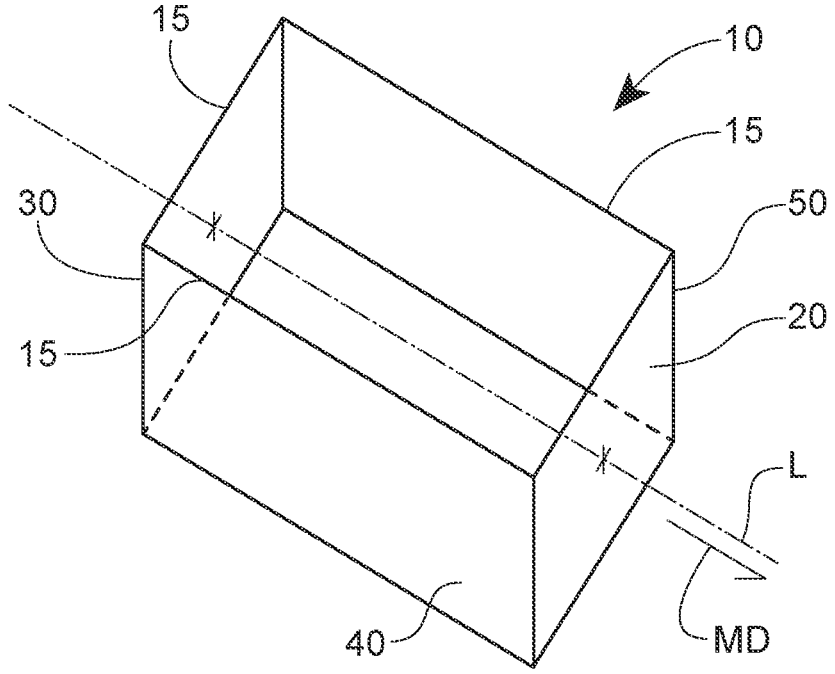
FIG. 1 is a tray.

A tray 10 employed in the process is shown in FIG. 1. The tray 10 and hood can be formed of paperboard or corrugate. Paperboard and corrugate materials can comprise pulp. The paperboard or corrugate can have a thickness from 1 mm to about 3 mm. The paperboard or corrugate can be a laminate. The paperboard or corrugate can comprise pulp. The paperboard or corrugate can comprise colorants, preservatives, plasticizers, ultraviolet stabilizers, oxygen, perfume, recycled materials, moisture barriers, and combinations thereof. Corrugate can comprise a laminate of two sheets of paperboard having a fluted layer disposed between the two sheets of paperboard. Each of the tray 10 and hood can be a single piece of die cut paperboard or corrugate having a pattern of the faces of the tray 10 or hood and flaps extending from the faces or panels. The tray 10 or hood can be erected by joining a combination of the flaps or a combination of the flaps and faces or panels to erect the tray 10 or hood. The flaps and or faces or panels can be joined to one another by gluing, thermal bonding, fitting tabs to slots, and engaging interlocking structures.

The tray 10 can be conveyed in a machine direction MD. The tray 10 can comprise a leading face 20 and a trailing face 30 upstream of the leading face. The tray 10 can have a front face 40 and a back face 50 opposite the front face 40. The front face 40 and the back face 50 extend from the leading face 20 to the trailing face 30 in the machine direction MD. The tray 10 can comprise a peripheral rim 15 defining a top opening of the tray 10. The tray 10 can have a longitudinal axis L in line with the machine direction MD.

Figure 2:
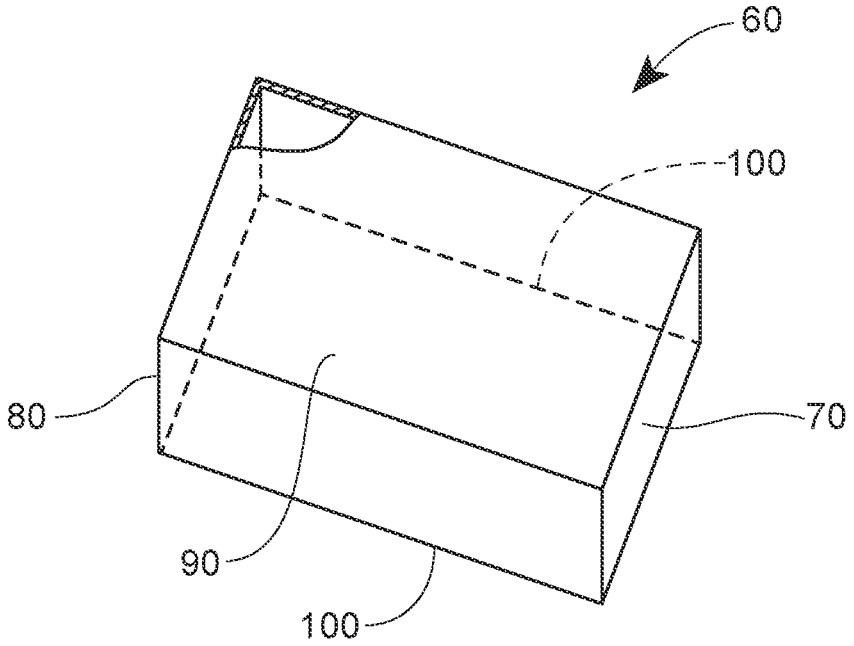
FIG. 2 is a hood.
Figure 3:
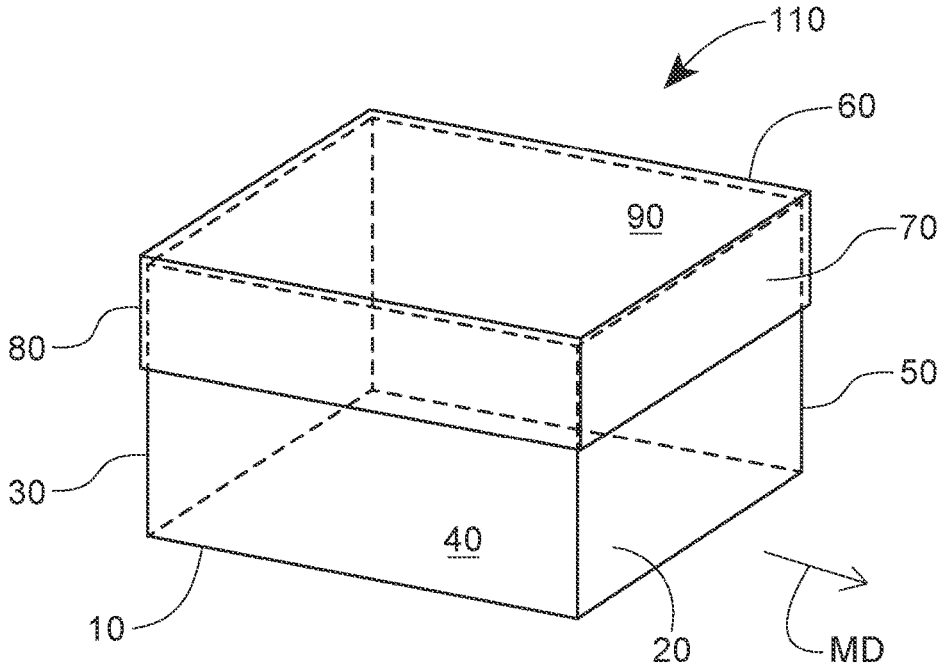
FIG. 3 is a tray having a hood fitted thereto.

A hood 60 employed in the process is shown in FIG. 2. The hood 60 can comprise a leading panel 70, trailing panel 80 opposite to and upstream of the leading panel 70, and a hood top 90 extending from the leading panel 70 to the trailing panel 80. The hood 60 can comprise a pair of opposing hood side peripheral edges 100. The hood 60 can be telescopically fitted to the tray 10 to form a closed package 110 (FIG. 3).

Figure 4:
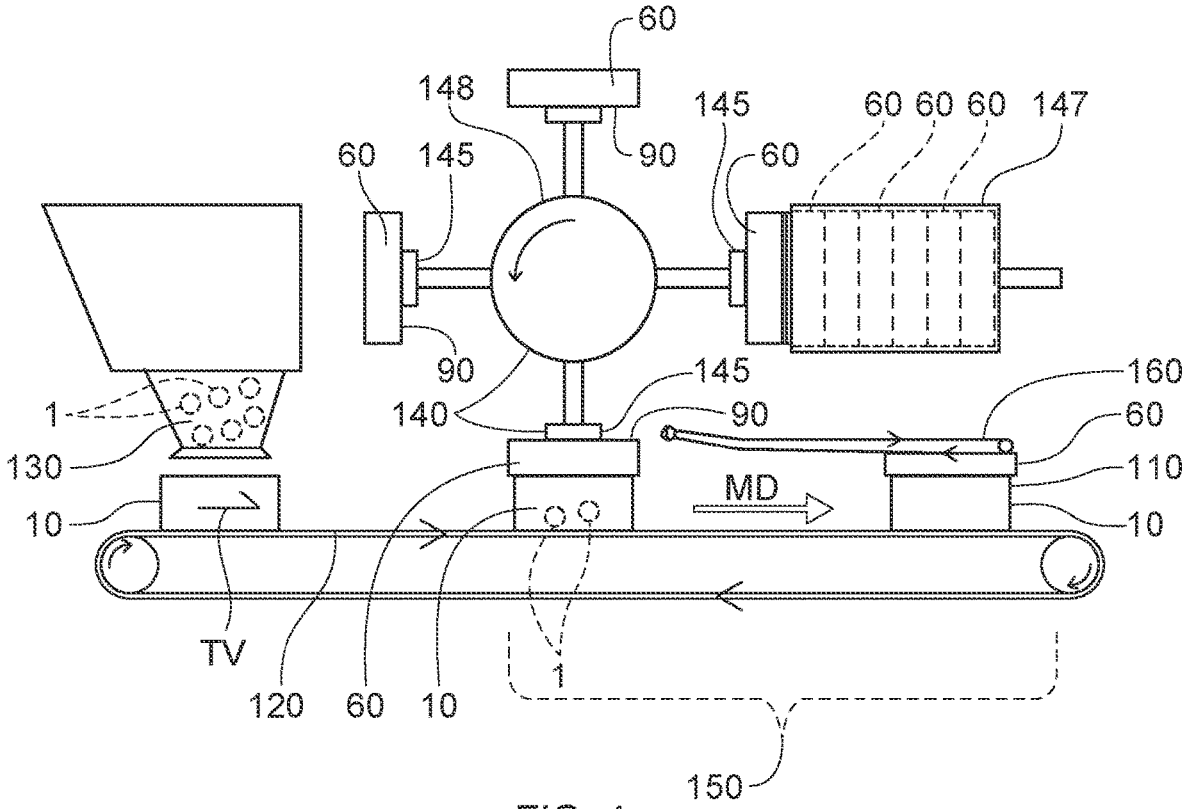
FIG. 4 is a packaging line for dispensing products into a tray and fitting a hood to the tray to close the package.

The high speed process for dispensing a product 1 into a tray 10 described herein can be part of an end to end process for packaging a product 1, as shown in FIG. 4. The steps of the process can include manufacturing the product 1. The product 1 can be a substrate treatment composition. A tray carriage system 120 can be provided. The tray 10 can be provided and be movable in or on the tray carriage system 120. The tray 10 can be moved at the tray velocity TV via the tray carriage system 120 in the machine direction MD. The tray velocity TV can be constant or variable.

A dispensing system 130 can be provided and the product 1 can be dispensed into the tray 10 via the dispensing system 130. The product 1 can be a water soluble unit dose laundry or dish cleaning product. The product 1 can be TIDE PODS, ARIEL 3 IN 1 PODS, FAIRY ALL IN ONE, CASCADE ACTION PACKS, CASCADE PLATINUM, and the like available from The Procter & Gamble Company.

A hood engagement system 140 can be provided above the tray carriage system 120 and downstream of the dispensing system 130. The hood 60 is engaged with the tray 10 via the hood engagement system 140 to close the tray 10 to form the closed package 110. The hood engagement system 140 can be a rotary hood engagement system 140 that fits a hood 60 to a tray as the tray 10 passes beneath the hood engagement system 140. The hood engagement system 140 can include a plurality of suction heads 145 that engage the hood top 90. The hood 60 can be picked up by the suction head 145 as the suction head 145 passes a hood magazine 147. The hood magazine 147 can serially feed a hood 60 to be engaged with the suction head 145 as the suction head 145 rotates past the hood magazine 147. The suction heads 145 can be mounted on a rotating turret 148. Suction applied to the suction head 145 holds the hood 60 against the section head 145. Movement and control of the rotating turret 148 and the tray carriage system 120 can be coupled so that the hood 60 can be fitted to a tray 10 as the tray passes beneath the hood engagement system 140. The angular velocity of the rotating turret 148 can be constant or variable. Rotation of the rotating turret 148 can be indexed so that the hood 60 can be fitted to a tray 10 passing beneath the rotating turret 148. When the hood 60 is above the tray 10, suction on the suction head 145 can be released to drop the hood 60 and fit the hood 60 onto the tray 10. Optionally the suction head 145 can moved in the radial direction to push or slightly push the hood 60 onto the tray 10.

The hood 60 and tray 10 can be engaged at a merging location 150 along the tray carriage system 120. The hood engagement system 140 can further comprise a hood guide 160 above the tray carriage system 120 at or in or downstream of the merging location 150. The hood guide 160 can be nearer to the tray carriage system 120 downstream of the merging location 150 than at the merging location 150. The hood guide 160 can contact the hood top 90 to telescopically fit the hood 60 onto the tray 10. The hood guide 160 can be a wedge that pushes the hood 60 to fit to the tray 10. The hood guide 160 can be a belt that is positioned at a small angle relative to the machine direction MD to force the hood 60 to fit to the tray.

After the hood 60 is fitted to the tray 10, the closed package 110 can be further processed and shipped. For example the closed package 110 can be shipped to a distributor or distribution facility and further along the supply chain until it reaches a location at which a user can open the package 110 by removing the hood 60, retrieve the product 1 from the tray 10, and use the product 1.

Figure 5:
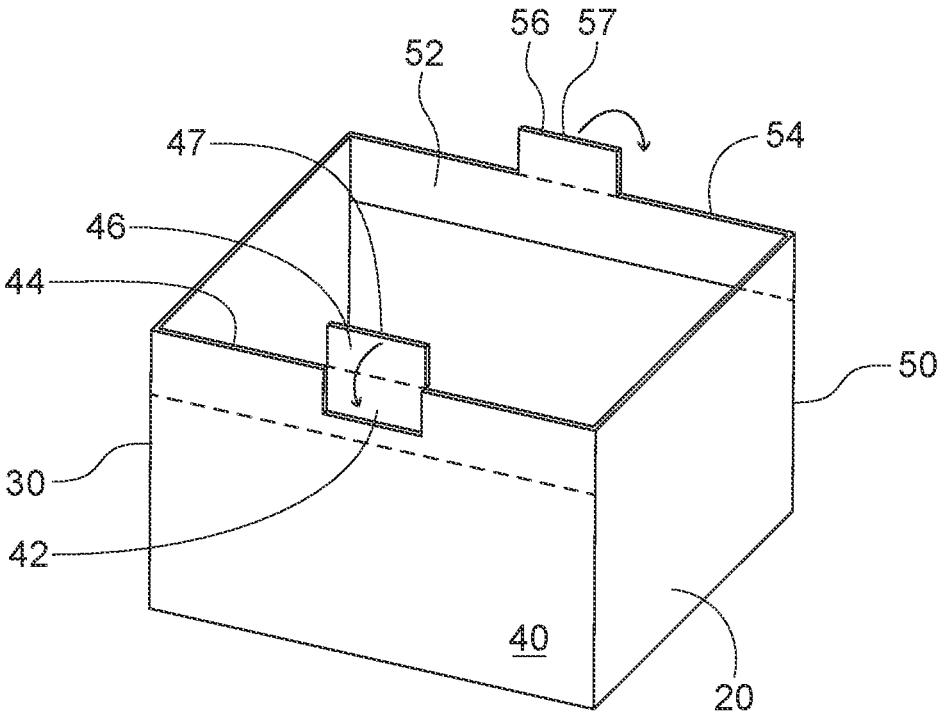
FIG. 5 is a tray having flaps.

The tray 10 can have a front face fold back 42 that is an integral extension of the front face 40 folded towards the interior of the tray 10 along a front face fold line 44 (FIG. 5). Similarly, the tray 10 can have a back face fold back 52 that is an integral extension of the back face 50 folded towards the interior of the tray 10 along a back face fold line 54. The front face fold back 42 and back face fold back 52 can provide for additional rigidity to the peripheral rim 15 of the tray 10.

A front face flap 46 can extend from the peripheral rim 15 along the front face 40. The front face flap 46 can extend from the front face 40 to a front face flap distal end 47. A back face flap 56 can extend from the peripheral rim 15 along the back face 50. The back face flap 56 can extend from the back face 50 to a back face flap distal end 57. The front face flap 46 and back face flap 56 can be structured from a cutlines on in the front face 40 and back face 50, respectively. The front face fold back 42 and back face fold back 52 can extend more deeply into the tray 10 than the cut lines that form the boundary of the front face flap 46 and back face flap 56.

The front face fold line 44 and back face fold line 56 can be orthogonal to the flutes if the tray is constructed from corrugate. For corrugate, folding perpendicular to the flutes can provide for a hinge having springiness about the fold. For the tray 10 described herein, the springiness can be employed to form a closure system that engages the hood 60 with the tray 10 that can be opened and closed multiple times.

The blank from which the tray 10 is erected can include cut lines that define the shape and dimensions of the front face flap 46 and back face flap 56 and the cut lines can be positioned so that when the tray 10 is erected the front face flap 46 and the back face flap 56 are positioned as desired. As part of the process of erecting the tray 10 from the blank, the front face fold back 42 and back face fold back 52 can be folded towards the interior of the tray 10. The parts of the front face fold back 42 and the back face fold back 52 from which the front face flap 46 and the back face flap 56 extend, respectively, can be unfolded and pointing upward after the tray 10 is erected. When the tray 10 is erected and the front face fold back 42 and the back face fold back 52 are folded towards the interior of the tray 10, the front face flap 46 and the back face flap 56 can protrude upwardly from the peripheral rim 15 of the tray 10.

As part of the process of packaging the product 1, the front face flap 46 and the back face flap 56 can be folded outwardly away from the interior of the tray 10 before engaging the hood 60 with the tray 10. The front face flap 46 and the back face flap 56 can be held down while engaging the hood 60 with the tray 10. The front face flap 46 and the back face flap 56 can be outwardly folded by a pair of folding rails that are associated with the tray carriage system 120. The folding rails can be provided upstream of the hood engagement system 140. As the tray 10 is transported downstream, the folding rails can capture the distal ends of the flaps and movement of the tray 10 downstream and shaping of the folding rails can bend the front face flap 46 and the back face flap 56 outwardly away from the interior of the tray 10 so that the distal ends of the respect flaps are oriented towards the bottom of the tray 10.

Figure 6:
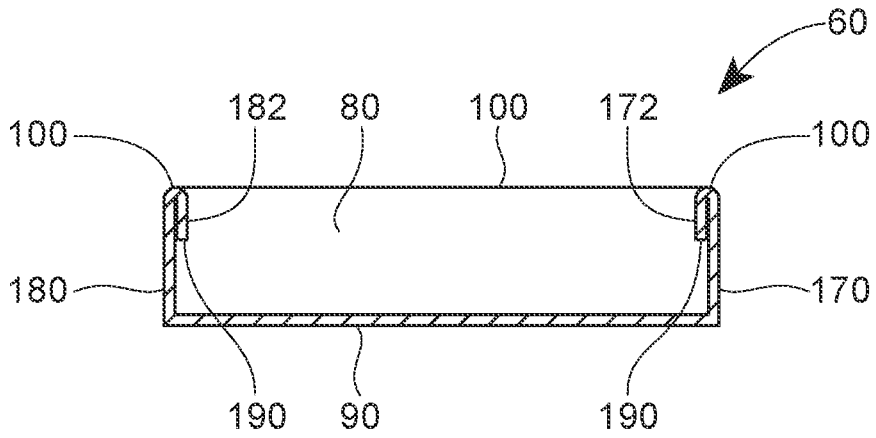
FIG. 6 is a cross section of a hood having inwardly folded flaps along the front panel and back panel.
Figure 7:
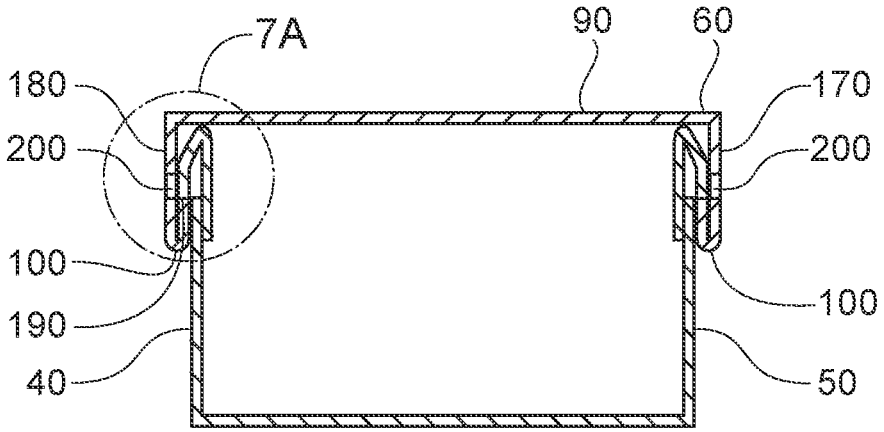
FIG. 7 is a cross section illustrating the fit of a flap to an inwardly folded flap to secure the hood to the tray.
Figure 7A:
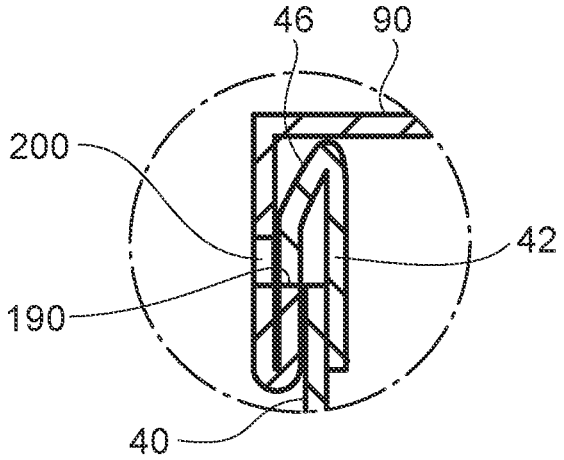
FIG. 7A is a partial view, as marked in FIG. 7, illustrating the fit of a flap to an inwardly folded flap to secure the hood to the tray.

The hood 60 can be provided with an engagement mechanism the cooperates with the front face flap 46 and back face flap 56, by way of nonlimiting example as shown in FIG. 6. FIG. 7 is a cross section of a hood 60 looking in the upstream direction toward the hood trailing panel 80. The hood 60 can further comprise a front panel inwardly folded flap 172 extending from the front panel 170 and a back panel inwardly folded flap 182 extending from the back panel 180. Together the front panel 170 and back panel 180 can extend from the leading panel 70 to the trailing panel 80. And the front panel inwardly folded flap 172 and the back panel inwardly folded flap 182 can be between the front panel 170 and the back panel 180.

Figure 8:
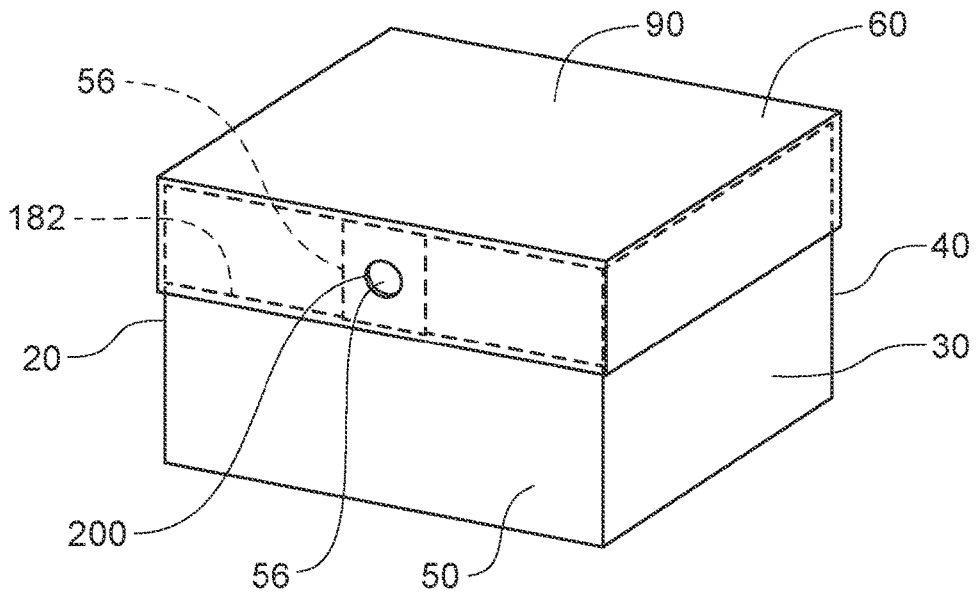
FIG. 8 is a package in which the hood is provided with an aperture so that the user can access the inwardly folded flaps to open the package.

When the hood 60 is fitted to the tray 10, the distal ends of the front face flap 46 and back face flap 56 can engage with the ends 190 of the front panel inwardly folded flap 172 and the back panel inwardly folded flap 182, respectively (FIG. 7). The user can unlock the hood 60 from the tray 10 by pushing on the front face flap 46 and the back face flap 56 to release the distal ends of front face flap 46 and the back face flap 56 from contact with the ends 190 of the front panel inwardly folded flap 172 and the back panel inwardly folded flap 182, respectively. The front face flap 46 and the back face flap 56 rotate about a hinge formed by the front face fold line 44 and the back face fold line 54. The front face flap 46 can be accessed through an aperture 200 in the front panel 170. The back face flap 56 can be accessed through an aperture 200 in the back panel 180 (FIG. 8).

The hood engagement system 140 is the mechanism for positioning a hood 60 so that the hood 60 can be fitted to a tray 10 as the tray 10 moves downstream in the machine direction MD.

Figure 9:
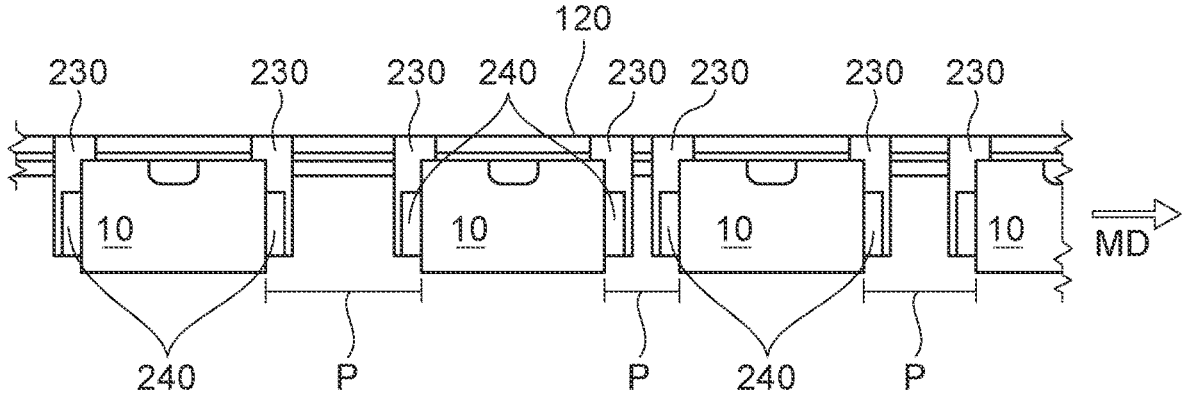
FIG. 9 is a tray carriage system.

Precise control of movement of the tray 10 can be provided a carriage system 120 comprising a plurality of linear motor vehicles 230 (FIG. 9). The carriage system 120 can be a horizontally oriented track system in which movement of individual linear motor vehicles 230 is controlled. A suitable linear motor track system can be an ITRAK system from Rockwell Automation. A tray 10 can be conveyed by adjacent linear motor vehicles 230. Each linear motor vehicle 230 can have a restraint plate 240 attached thereto. The restraint plate 240 can be oriented orthogonal to the machine direction MD. Each tray 10 can be held by restraint plates 240 of adjacent linear motor vehicles 230. In operation, adjacent pairs of linear motor vehicles 230 can be individually controlled or controlled in pairs to hold a tray 10 between the restraint plates 240 of adjacent linear motor vehicles 230.

The pitch P amongst trays 10 can be nonconstant and individually controlled. The position of individual trays 10 can be controlled to match up with the position of the hood 60 being fitted thereto. Vision systems or sensors can detect the position and speed of the hood 60 and a computer system can adjust the velocity of the tray 10 so that the hood 60 is fitted to a tray 10 as the tray 10 passes through the location at which the hood 60 merges with the tray 10.

The carriage system 120 can be configured to convey the trays 10 in a condition in which the tray 10 is squeezed in the longitudinal direction so that the front face 40 and back face 50 are outwardly bowed away from the longitudinal axis L. The outward bowing of the front face 40 and the back face 50 can arise during manufacture of the flat paperboard or corrugate. The amount of force applied in the machine direction MD and counter to the machine direction MD by the carriage system 120 can increase the amount of bowing as compared to the amount of bowing that might arise due to manufacture of the flat paperboard or corrugate and that which might arise as a result of transforming the flat paperboard or corrugate into a three-dimensional tray 10. Outwardly bowing the front face 40 and the back face 50 can help provide for a tight fit between the hood 60 and the tray 10 and a secure engagement of the locking mechanism. The tray 10 can be bowed, by way of non-limiting example, in a carriage system 120 that employs linear motor vehicles 230 by controlling or setting the spacing between adjacent linear motor vehicles 230. The spacing between adjacent linear motor vehicles 230 can be set to be less than the distance between the leading face 20 and trailing face 30, as measured between the outer surfaces, of the tray 10 in an unloaded condition. The software operating the adjacent linear motor vehicles 230 can be programmed to control the amount of bowing desired at different positions along the carriage system 120, which may vary as a function of position.

As described previously and shown in FIG. 6, the hood 60 can comprise a front panel inwardly folded flap 172 and a back panel inwardly folded flap 182. The hood 60 can be sized and dimensioned to fit tightly with the tray 10 so that the tray 10 may be securely closed.

Figure 10:
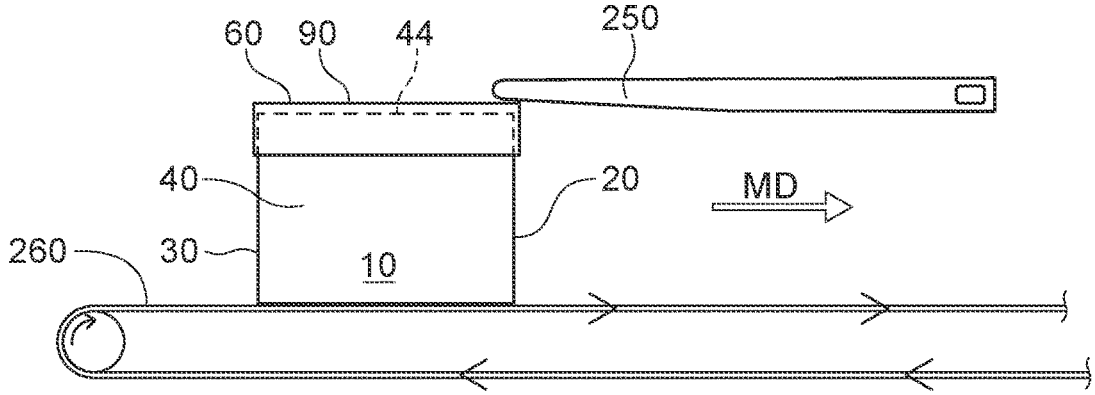
FIG. 10 illustrates a bumper system for telescopically fitting a hood to a tray after the hood has been partially to a tray.

After the tray 10 has a hood partially fitted thereto, the hood 60 can be further fitted to the tray 10 by providing a bumper 250 that pushes the hood 60 onto the tray 10 as the tray 10 moves further downstream in the machine direction MD (FIG. 10). The bumper 250 can be configured to provide a reaction surface against which at least part of the hood 60 contacts. The distance between portions of the bumper 250 and the carriage system 120 can decrease as a function of distance in the machine direction. The bumper 250 can function as a wedge that pushes the hood 60 down onto the tray 10 as the tray 10 and hood 60 are conveyed in the machine direction downstream. The further fitting of the hood 60 to the tray 10 downstream of location at which the hood 60 is first fitted to the tray 10 can occur while the tray 10 is held and under the control of the carriage system 120. As the tray 10 and hood 60 move in the machine direction, the hood 60 can be further telescopically fit to the tray 10. The bumper 250 can have a smooth surface that engages with the hood 60 so that the hood 60 slides easily along the bumper 250. The smooth surface of the bumper 250 can be a polished steel or aluminum surface or a plastic material such as an acetal plastic or other plastic material having a low coefficient of friction and a smooth finish. The bumper 250 can be a static bumper, a movable belt, a moveable rope, or the similar mechanism for applying force to fit the hood 60 more closely to the tray 10.

After the trailing panel 80 is fitted to the tray 10, the tray 10 and hood 60 engaged therewith can be handed off from the carriage system 120 to a downstream conveyor 260. A second bumper 250 can be positioned above the downstream conveyor 260 to further telescopically fit the hood 60 to the tray 10. The second bumper 250 can be wedge shaped or positioned to present a wedging surface to the hood 60 as the tray 10 and hood 60 are conveyed further downstream in the machine direction.

After the hood 60 is fitted to the tray 10 to form a closed package 110, the closed package 110 can be further processed and or finished and shipped from the location at which the closed package 110 is assembled. The closed package 110 can be shipped to a distribution center, customers, or consumers to finally reach the location at which the user opens the package 110 to use or consume the contents of the package 110.

A dispensing system 130 can be provided and the product 1 can be dispensed into the tray 10 via the dispensing system 130. A hood engagement system 140 can be provided above the tray carriage system 120 and downstream of the dispensing system 130.

The hood 60 is engaged with the tray 10 via the hood engagement system 140 to close the tray 10 to form the closed package 110. The hood 60 can be engaged with the tray 10 while the tray 10 is moving in the machine direction MD.

After the hood 60 is fitted to the tray 10, the closed package 110 can be shipped. For example the closed package 110 can be shipped to a distributor or distribution facility and further along the supply chain until it reaches a location at which a user can open the package 110 by removing the hood 60, retrieve the product 1 from the tray 10, and use the product 1.

The hood 60 may tightly conform to the tray 10 to provide for a robust connection between the hood 60 and tray 10 for the closed package 110. If the conformance between the hood 60 and the tray 10 is tight, processes that operate at a fixed rate with little or no control over movement of one or both of the hood 60 and tray 60 may be inadequate to enable the tray 10 to catch a hood 60 as the hood merges with the tray 10.

The dispensing system 130 can be a hopper, for example a clamshell hopper, that opens when a tray 10 is beneath the dispensing system 130 to drop products 1 into the tray. With the hopper in the closed position, a certain count or weight of products 1 can be fed into the hopper. When a tray is passing beneath the hopper, the hopper can open and drop the products 1 into the tray 10. Optionally, the dispensing system 130 can be chute into which a certain count or weight of products 1 are fed and directed into a tray 10 passing beneath the dispensing system. Optionally, the dispensing system 130 can be a gated chute. When the gate is closed products 1 can be fed into the chute. When the tray 10 is passing beneath the chute, the gate can open to release the products 1 and drop them into the tray 10 passing underneath. The dispensing system 130 can be horizontal or vertically oriented carousel for dispensing a certain count or weight of products 1. The dispensing system 130 can include a shuttle and dispense products 1 as the dispensing system 130 moves downstream in the machine direction MD and then shuttles back upstream to dispense products 1 into the next arriving tray 10.

Figure 11:
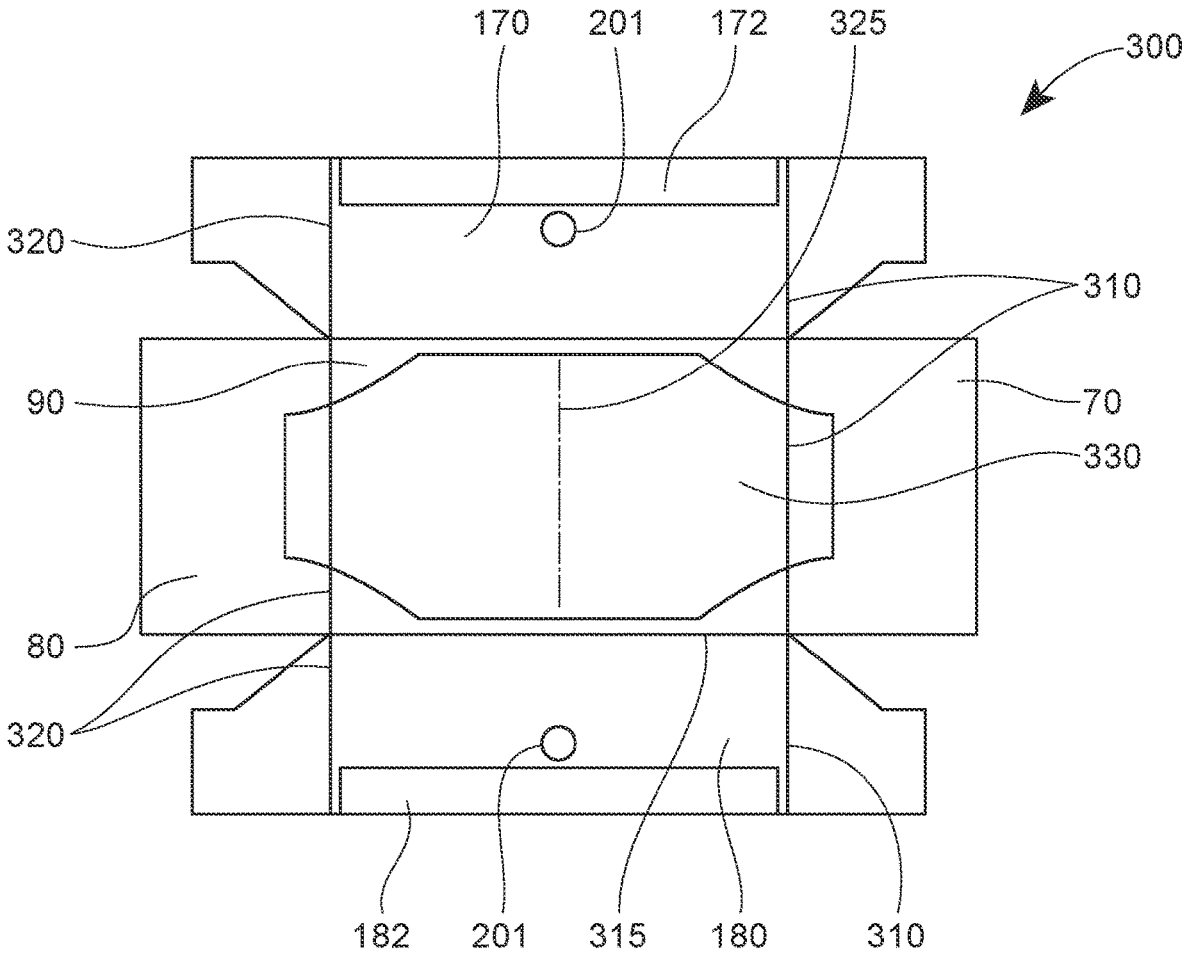
FIG. 11 is flat blank and a flat insert adhered thereto.

The hood 60 can be erected from a flat blank 300 (FIG. 11). The flat blank 300 can comprise a leading panel 70, a trailing panel 80 opposite the leading panel 70, and hood top 90 extending between the leading panel 70 and the trailing panel 80. The flat blank 300 can further comprise a front panel 170 and the back panel 180. The flat blank 300 can be provided with a plurality of fold lines. When the hood 60 is erected, the flat blank 300 can be folded about the fold lines to transform the flat blank 300 from an essentially two-dimensional structure into a three-dimensional structure. The fold lines can be continuous or intermittent. The fold lines can be a preferentially weakened portion of the flat blank 300. The fold lines can be formed by indenting the paperboard or corrugate from which the flat blank 300 is constructed. Optionally, the fold lines can be formed by scoring the paperboard or corrugate from which the flat blank 300 is constructed.

The flat blank 300 can comprise a leading fold line 310 between the leading panel 70 and the hood top 90. The flat blank 300 can comprise a trailing fold line 320 between trailing panel 80 and the hood top 90. The flat blank 300 can further comprise side fold lines 315. The side fold lines 315 form the boundary between the hood top 90 and each of the front panel 170 and back panel 180. Optionally, the flat blank 300 can further comprise a central fold line 325 parallel to the leading folding line 310 and the trailing fold line 320. The central fold line 325 can provide a line about which the central portion 330 can bend to become spaced apart from the hood top 90 at a desired location.

To provide a mechanism for reducing the potential for excessively deforming the tray 10 at and nearby the front face flap 46 and back face flap 56, a flat insert 330 can be adhered to a panel selected from the group of the leading panel 70, the trailing panel 80, and combinations thereof. The flat insert 330 can be adhered to a surface selected from the group of the leading panel 70, the trailing panel 80, the hood top 90, and combinations thereof. The flat insert 330 has a central portion 340 between the leading fold line 310 and the trailing fold line 320. The central portion 340 can be unattached to the hood top 90.

When erected, the flat insert 330 is transformed into a three-dimensional shape that provides structural support behind the front face flap 46 and the back face flap 56. Recall, that the locking mechanism between the hood 60 and the tray 10 relies on the end 190 of the of the front panel inwardly folded flap 172 abutting the front face distal end 47 of the front face flap 46 and the end 190 of the back panel inwardly folded flap 182 abutting the back face distal end 57 of the back face flap 56. The user can push the front face flap 46 and back face flap 56 to disengage the front face flap 46 and the back face flap 56 from the end 190 of the front panel inwardly folded flap 172 and the end 190 of the back panel inwardly folded flap 182, respectively. If the user pushes too hard on the front face flap 46 and the back face flap 56, there could be regional deformation of the tray 10 near the front face flap 46 and back face flap 56 which could weaken the engagement of the front face flap 46 and the back face flap 56 from an end 190. If the tray 10 is plastically deformed near the front face flap 46 and the back face flap 56, the front face flap 46 and the back face flap 56 may fail to engage at all with an end 190.

The front panel 170 and the back panel 180 can comprise a predetermined removable portion 201. The predetermined removable portion 201 can be a partial die cut or perforation that defines the shape of the predetermined removeable portion 201. When the user obtains the package 110, the user can punch out the predetermined removable portions 201 to form the apertures 200. The user can then access the front face flap 46 and the back face flap 56 to disengage the hood 60 from the tray 10.

The flat insert 330 can be corrugate having flutes and the flutes extending in a direction between the front panel 170 and the back panel 180. The flat insert 330 can be paperboard.

Figure 12:
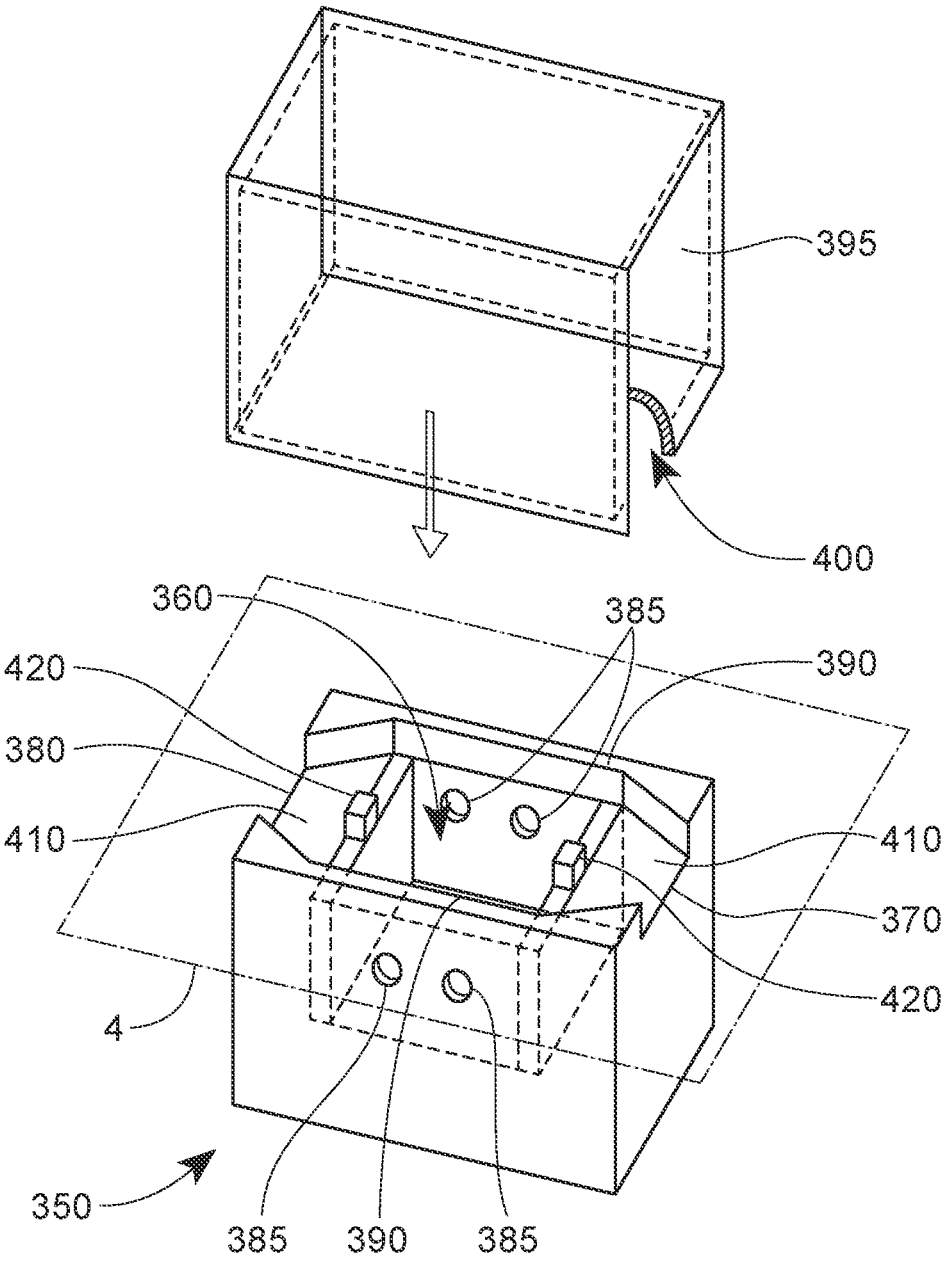
FIG. 12 is a die and a hood mold.

The hood 60 can be erected using a die 350 and a hood mold 395 (FIG. 12). The die 350 can be positioned in facing relationship with the flat blank 300 and punched into a mold to transform the flat blank 300 into the hood 60. When the flat blank 300 is transformed into a hood 60, the central portion 340 of the flat insert 330 can become spaced apart from the hood top 90.

The die 350 can be metal, plastic, or an assembly of components of metal and plastic.

Conventionally, dies that are employed to construct simple hoods, like those found in a common bankers box, shoe box, or the like, present a flat surface to contact the hood top. In the present application, the die 350 comprises a die recess 360. The die recess 360 can accommodate separation of the central portion 340 from the hood top 90. The central portion 340, when spaced apart from the hood top 90, can provide for structural support behind the front face flap 46 and the back face flap 56 to limit undesirable deformation of the front face 40 and back face 50 near the front face flap 46 and the back face flap 56.

The die 350 can comprise a leading edge 370 and trailing edge 380 and a pair of side edges 390 extending from the leading edge 370 to the trailing edge 380. The die 350 can comprise a die recess 360 that is recessed relative to the leading edge 370, the trailing edge 380 and the side edges 390.

The hood mold 395, which comprises a cavity 400, can be provided. The cavity 400 provides the three-dimensional space to accommodate the erected hood 60. To erect the hood 60, the flat insert 330 is oriented towards the die recess 360. The leading fold line 310 can be positioned in line with the leading edge 370 of the die 350. The trailing fold line 320 can be positioned in line with the trailing edge 380.

The die 350 can be positioned within the hood mold 395 to fold the flat blank 300 about the leading fold line 310 and the trailing fold line 320 and to fold the flat insert 330 coincidentally with the leading fold line 310 and the trailing fold line 320. By way of this folding, the central portion 340 is spaced apart from the hood top 90.

The die 350 can be pressed into the hood mold 395. Optionally, the hood mold 395 can be pressed to fit over the die 350. Optionally both the die 350 and the hood mold 395 can be pressed so that the die 350 is within the hood mold 395.

As the leading panel 70 and trailing panel 80 are bent about the leading fold line 310 and trailing fold line 32, the portions of the flat insert 330 adhered thereto are also bent about the relevant fold line. Since the flat insert 330 is adhered to a panel selected form the leading panel 70, the trailing panel 80, and combinations thereof, there is no shear displacement between the flat insert 330 and the panel or panels to which the flat insert 330 is attached. The radius of the bend of the flat insert 330 is smaller than the radius of the bend between the leading panel 70 and the hood top 90 and the radius of the bend between the trailing panel 80 and the hood top 90. Since there is no change in the length of the central portion 340 between leading fold line 310 and the trailing fold line 320, the central portion 340 is forced out of plane relative to the hood top 90. The die recess 360 can provide for space to accommodate the out of plane deformation of the central portion 340.

The central fold line 325 can provide for controlled deformation of the central portion 340. The central fold line 325 can be midway between the leading fold line 310 and the trailing fold line 320. Providing a central fold line 325 can help to center the location where the maximum separation between the central portion 340 the hood top 90 occurs. By centering such location, the central fold line 325 can proximal or even behind the location of the front face flap 42 and the back face flap 56 when the hood 60 is engaged with the tray 10. At least part of the central portion 340 can form an angle about the central fold line 325.

The die 350 can further comprise a pair of flat insert seating areas 410. One of the flat insert seating areas 410 can be between the leading edge 370 and the die recess 360 and another of the flat seating areas 410 can be between the trailing edge 380 and the die recess 360. The flat insert seating areas 410 can be sized and dimensioned to accommodate portions of the flat insert 330 that are adjacent the leading fold line 310 and the trailing fold line 320. That is, the flat insert seating areas 410 can be sized and dimensioned to accommodate portions of the flat insert 330 that extend beyond die recess 360.

The flat insert seating areas 410 provide space within which the flat insert 330 can be seated so that when the die 350 is fitted with in the hood mold 395, portions of the flat insert 330 near the leading edge 370 and the trailing edge 380 do interfere with forming precise fold lines between the hood top 90 and the leading panel 70 and the hood top 90 and the trailing panel 80. Sizing and dimensioning the flat insert seating areas 410 to have a shape that is the same as or closely similar to the shapes of the flat insert 330 that extend beyond the die recess 360 can provide for crisper folding at the boundary between the hood top 90 and the leading panel 70 and trailing panel 80 since the die 350 can contact more of the surface of the flat blank 300.

The flat insert seating areas 410 can be recessed relative to the side edges 290 and be sized and dimensioned to accommodate portions of the flat insert 330 that extend beyond the die recess 360. In such an arrangement, the flat insert 330 may not interfere with formation of crisp folds between the hood top 90 and the front panel 170 and back panel 180 as well as between the hood top 90 and the leading panel 70 and trailing panel 80.

Optionally, between at least part of each flat insert seating area 410 and the die recess 360, a tab 420 can project above the flat insert seating areas 410. Each tab 420 can be located at or near, or substantially at or near, the boundary between each flat insert seating area 410 and the die recess 360. When the hood 60 is being erected, these tabs 420 can induce a fold line to form in the flat insert 330 at or near the boundary between the flat insert seating areas 410 and the die recess 360. This can be beneficial in that it can provide for a shaped transition between the central portion 340 that is spaced apart from the hood top 90 and the locations where the flat insert 330 is bent about the leading edge 370 and the trailing edge 380. Moreover, when the hood 60 is erected, the central portion 340 may be under residual stress and the shaped transition may help to direct these residual stresses to be predominantly orthogonal to the leading panel 70 and the trailing panel 80.

The tabs 420 can project 0.5 mm to about 3 mm, optionally 2 mm, above the side edges 390. The thicker the paperboard or corrugate constituting the flat insert 330, the greater amount of projection that might be possible. The side edges 390 can define a forming plane 430 and the tabs 420 can project above the forming plane 430 (i.e. in a direction away from the die recess 360).

The die 350 can further comprise vent holes 385 within the die recess 360. The vent holes 385 can be beneath the side edges 390. The vent holes 385 can be elevationally lower than both the side edges 390 and the flat insert seating areas 410. The vent holes 385 can permit air to escape from the die recess 360 as the central portion 330 deforms inwardly into the die recess 360 and is spaced apart from the hood top 90.

Figure 13:
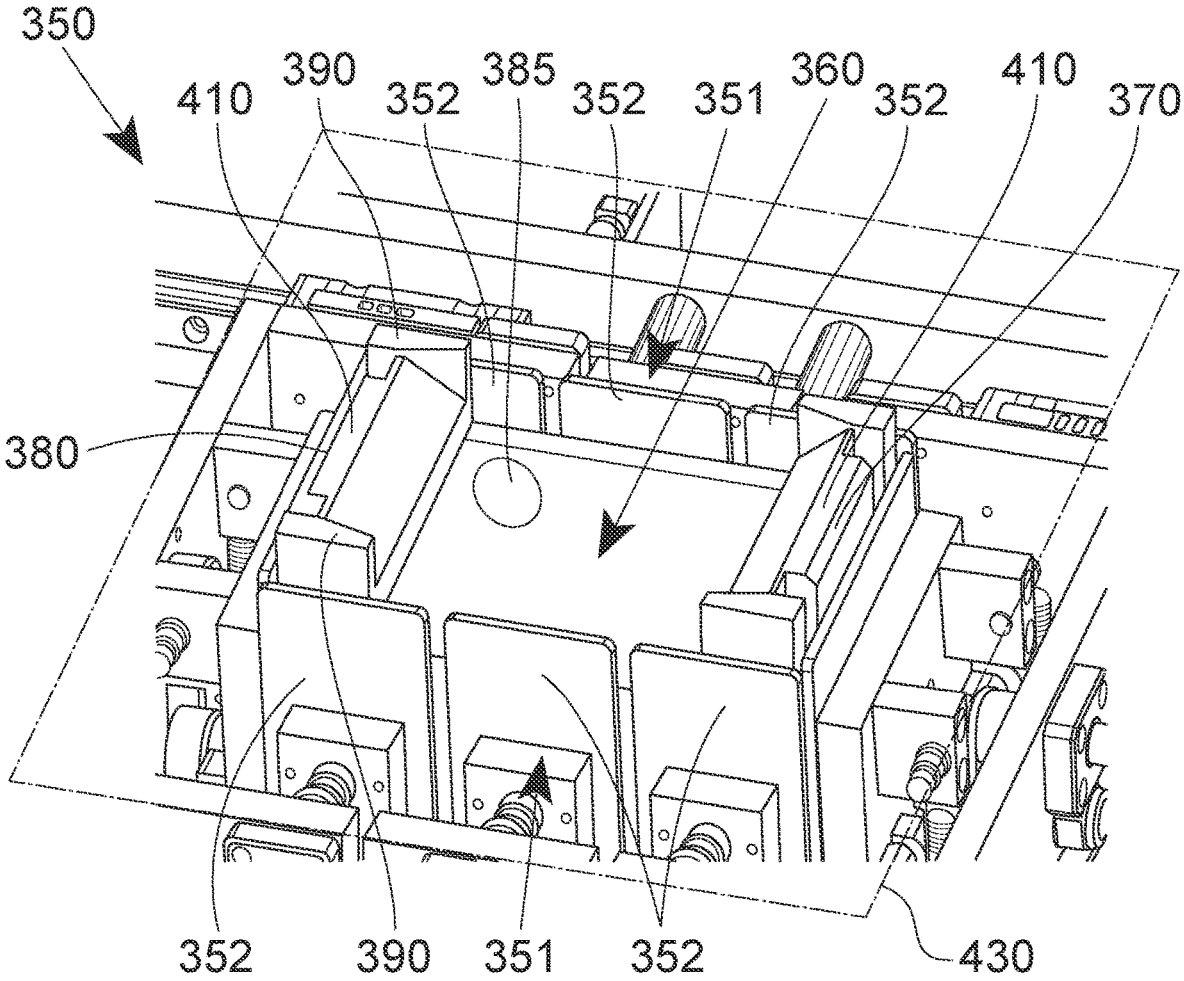
FIG. 13 is an expandable and contractable die.

The die recess 360 can have an adjustable volume. The adjustable volume can be provided for by a die 350 that is extendable and contractable in that the distance between the leading edge 370 and the trailing edge 380 is adjustable (FIG. 13). Such a die 350 can be practical to use for erecting hoods 60 of different sizes as define by the distance between the leading fold line 310 and the trailing fold line 320. An extendable and contractable die 350 can be provide by the die sidewalls 351 comprising a plurality sidewall segments 352. The sidewall segments can define or partially define the die recess 360. The sidewall segments 352 can be positioned to abut one another to provide for a small hood 60. The sidewall segments 352 can be positioned spaced apart from one another to form a large hood 60. The sidewall segments 352 permit the distance between the leading edge 370 and the trailing edge 380 to be fixed at different distances.

Figure 14:
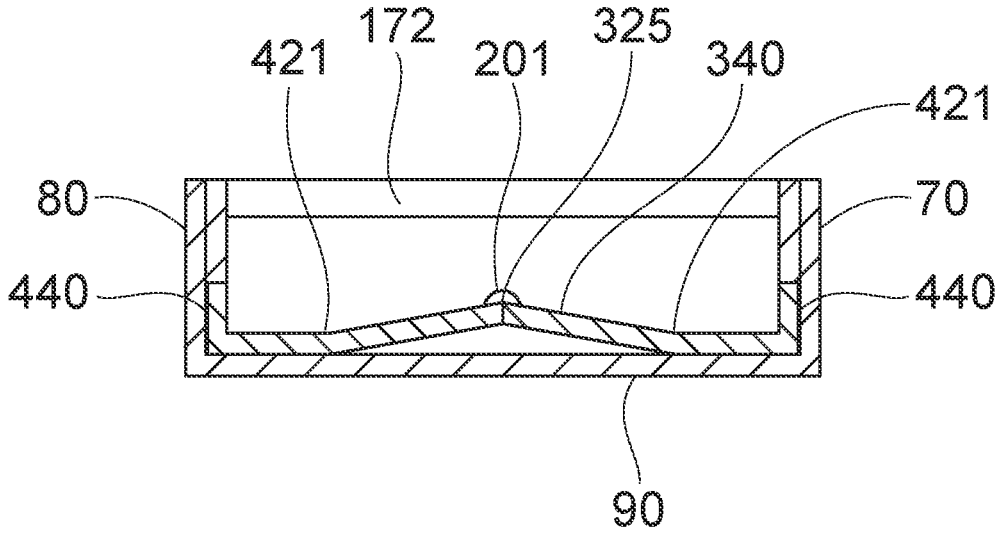
FIG. 14 is a cross sectional view of a hood top.

A cross section of a hood 60 is shown in FIG. 14. The hood 60 can comprise a pair of opposing predetermined removable portions 201 or apertures. As shown in FIG. 14, when the central portion 340 is spaced apart from the hood top 90, at least part of the central portion 340 can be positioned between the opposing predetermined removable portions 201 or apertures. Insert bend lines 421 are illustrated in FIG. 14, which can occur when the die 350 is provided with tabs 420 as described herein. The pair of insert bend lines 421 can be on opposite sides of the central fold line 325. One insert bend line 421 can be between the central fold line 325 and the leading panel 70. One insert bend line 421 can be between the central fold line 325 and the trailing panel 80. The flat insert 330 can be adhered to a panel selected from the leading panel 70, the trailing panel 80, and combinations thereof, by adhesive 440. The central bend lines 421 can be positioned so that when the central portion 340 is fitted to the die 350, they are near or at, or substantially near or at, the boundary between the flat insert seating areas 410 and the die recess 360. The central bend lines 421 can be positioned so that when the central portion 340 is fitted to the die 350, they are near or at, or substantially near or at, the locations of the tabs 420 that are optionally present at the boundary between the flat insert seating areas 410 and the die recess 360.

Figure 15:
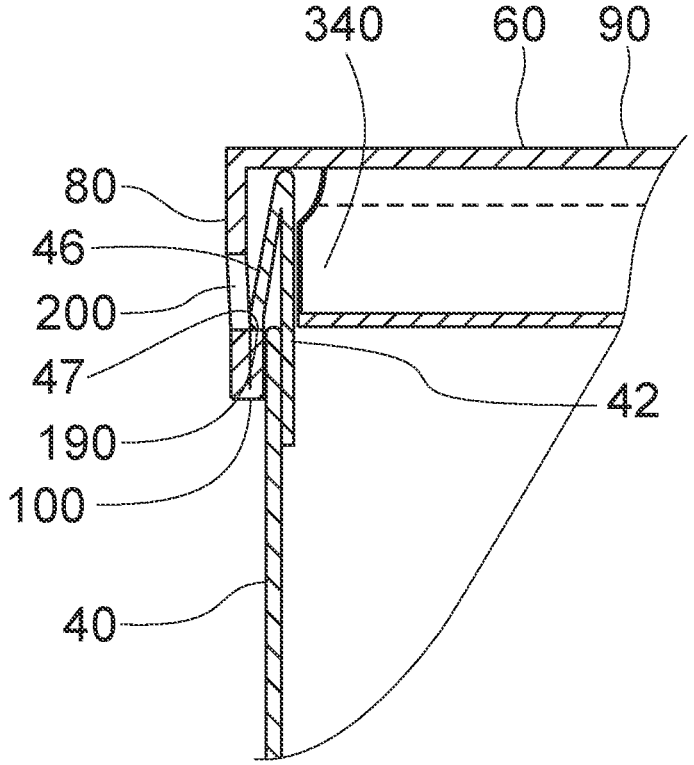
FIG. 15 is a partial cross sectional view of a hood top.

A partial cross section of another hood is shown in FIG. 15. As shown in FIG. 16, the central portion 340 can be positioned to provide structural support behind the front face flap 46 and the back face flap 56. When the user pushes inwardly the front face flap 46 and the back face flap 56 to disengage these flaps from the ends 190 of the front panel inwardly folded flap 172 and the back panel inwardly folded flap 172, the central portion can 340 can limit deformation of the tray near the front face flap 46 and the back face flap 56.

Combinations:

An example is below:

A. A process for packaging a product (1) comprising the steps of:
- manufacturing the product, wherein said product is a substrate treatment composition (2);
- providing a tray carriage system (120);
- providing a tray (10) movable in or on said tray carriage system;
- moving said tray via said tray carriage system in a machine direction (MD);
- providing a dispensing system (130) above said tray carriage system;
- dispensing said product into said tray via said dispensing system;
- providing a hood engagement system (140) above said tray carriage system and downstream of said dispensing system;
- providing a hood (60) moveable in said hood engagement system, wherein said hood is erected by a process comprising the steps of:
- providing a flat blank (300) comprising a leading panel (70), a trailing panel (80) opposite said leading panel, a hood top (90) extending between said leading panel and said trailing panel, a leading fold line (310) between said leading panel and said hood top, a trailing fold line (320) between said trailing panel and said hood top;
- providing a flat insert (330) adhered to a panel selected from the group of said leading panel, said trailing panel, and combinations thereof, wherein said flat insert has a central portion (340) between said leading fold line and said trailing fold line and wherein said central portion is unattached to said hood top;
- providing a die (350) comprising a leading edge (370) and trailing edge (380), a pair of side edges (390) extending from said leading edge to said trailing edge, and a die recess (360), wherein said die recess is recessed relative to said leading edge, said trailing edge, and said side edges;
- providing hood mold (395) having a cavity (400);
- orienting said flat insert towards said die recess; and positioning said die within said hood mold to fold said flat blank about said leading fold line and said trailing fold line and to fold said flat insert coincidentally with at least one of said leading fold line and said trailing fold line, whereby said central portion is spaced apart from said hood top;
- engaging said hood with said tray via said hood engagement system to fit said insert within said tray and close said tray to form a closed package (110); and shipping said closed package.

B. The process according to Paragraph A, wherein said die is pressed into said hood mold.

C. The process according to Paragraph A or B, wherein said flat insert comprises a central fold line parallel to said leading fold line and said trailing fold line.

D. The process according to any of Paragraphs A to C, wherein said die comprises a pair of flat insert seating areas (410), one of said flat insert seating areas between said leading edge and said die recess and another said flat insert seating area between said trailing edge and said die recess.

E. The process according to Paragraph D, wherein said flat insert seating areas are recessed relative to said side edges, wherein said flat insert seating areas are sized and dimensioned to accommodate portions of said flat insert that extend beyond said die recess.

F. The process according to Paragraph D or E, wherein between at least part of each flat insert seating area and said die recess a tab (420) projects above said flat insert seating areas.

G. The process according to Paragraph F, wherein said side edges define a forming plane (430), wherein said tabs project above said forming plane.

H. The process according to any of Paragraphs A to G, wherein said hood comprises at least one predetermined removable portion (201) or aperture, wherein when said central portion is spaced apart from said hood top at least part of said central portion is positioned behind said predetermined removeable portion or aperture.

I. The process according to any of Paragraphs A to H, wherein said flat insert is adhered to said leading panel and said trailing panel.

J. The process according to any of Paragraphs A to I, wherein said flat insert is folded coincidentally with said leading fold line and said trailing fold line.

K. The process according to any of Paragraphs A to J, wherein said hood comprises a pair of opposing predetermined removable portions (201) or apertures, wherein when said central portion is spaced apart from said hood top at least part of said central portion is positioned between said opposing predetermined removeable portions or apertures.

L. The process according to any of Paragraphs A to K, wherein said tray comprises a front face (40), a back face (50) opposite said front face, a front face flap (46) extending from said front face to a front face flap distal end (47), and a back face flap (56) extending from said back face (50) to a back face flap distal end (57), wherein said hood comprises a front face fold back (42) that is an integral extension of said front face and an opposing back face fold back (52) that is an integral extension of said back face, wherein said front face flap distal end is engaged with said front face fold back and said back face flap distal end is engaged with said back face fold back.

M. The process according to any of Paragraphs A to L, wherein said central portion comprises a central fold line (325) and at least part of said central portion forms an angle about said central fold line.

N. The process according to Paragraph M, wherein said central portion comprises a pair of insert bend lines (421), on opposite sides of said central fold line.

O. The process according to any of Paragraphs A to N, wherein said die comprises one or more vent holes 385 within said die recess.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for packaging a product comprising the steps of:

manufacturing the product, wherein said product is a substrate treatment composition;

providing a tray carriage system;

providing a tray movable in or on said tray carriage system;

moving said tray via said tray carriage system in a machine direction MD;

providing a dispensing system above said tray carriage system;

dispensing said product into said tray via said dispensing system;

providing a hood engagement system above said tray carriage system and downstream of said dispensing system;

providing a hood moveable in said hood engagement system, wherein said hood is erected by a process comprising the steps of:

providing a flat blank comprising a leading panel, a trailing panel opposite said leading panel, a hood top extending between said leading panel and said trailing panel, a leading fold line between said leading panel and said hood top, a trailing fold line between said trailing panel and said hood top;

providing a flat insert adhered to a panel selected from the group of said leading panel, said trailing panel, and combinations thereof, wherein said flat insert has a portion between said leading fold line and said trailing fold line unattached to said hood top;

providing a die comprising a leading edge and trailing edge, a pair of side edges extending from said leading edge to said trailing edge, and a die recess, wherein said die recess is recessed relative to said leading edge, said trailing edge, and said side edges;

providing hood mold having a cavity;

orienting said flat insert towards said die recess; and positioning said die within said hood mold to fold said flat blank about said leading fold line and said trailing fold line and to fold said flat insert coincidentally with at least one of said leading fold line and said trailing fold line, whereby said portion between said leading fold line and said trailing fold line unattached to said hood top is spaced apart from said hood top;

engaging said hood with said tray via said hood engagement system to fit said insert within said tray and close said tray to form a closed package; and shipping said closed package.

2. The process according to claim 1, wherein said die is pressed into said hood mold.

3. The process according to claim 1, wherein said flat insert comprises a fold line parallel to said leading fold line and said trailing fold line.

4. The process according to claim 1, wherein said die comprises a pair of flat insert seating areas, one of said flat insert seating areas between said leading edge and said die recess and another said flat insert seating area between said trailing edge and said die recess.

5. The process according to claim 4, wherein said flat insert seating areas are recessed relative to said side edges, wherein said flat insert seating areas are sized and dimensioned to accommodate portions of said flat insert that extend beyond said die recess.

6. The process according to claim 4, wherein between at least part of each flat insert seating area and said die recess a tab projects above said flat insert seating areas.

7. The process according to claim 6, wherein said side edges define a forming plane, wherein said tabs project above said forming plane.

8. The process according to claim 1, wherein said hood comprises at least one predetermined removable portion or aperture, wherein when said portion between said leading fold line and said trailing fold line unattached to said hood top is spaced apart from said hood top at least part of said portion between said leading fold line and said trailing fold line unattached to said hood top is positioned behind said predetermined removeable portion or aperture.

9. The process according to claim 1, wherein said flat insert is adhered to said leading panel and said trailing panel.

10. The process according to claim 1, wherein said flat insert is folded coincidentally with said leading fold line and said trailing fold line.

11. The process according to claim 1, wherein said hood comprises a pair of opposing predetermined removable portions or apertures, wherein when said portion between said leading fold line and said trailing fold line unattached to said hood top is spaced apart from said hood top and at least part of said portion between said leading fold line and said trailing fold line unattached to said hood top is positioned between said opposing predetermined removeable portions or apertures.

12. The process according to claim 1, wherein said tray comprises a front face, a back face opposite said front face, a front face flap extending from said front face to a front face flap distal end, and a back face flap extending from said back face to a back face flap distal end, wherein said hood comprises a front face fold back that is an integral extension of said front face and an opposing back face fold back that is an integral extension of said back face, wherein said front face flap distal end is engaged with said front face fold back and said back face flap distal end is engaged with said back face fold back.

13. The process according to claim 1, wherein said portion between said leading fold line and said trailing fold line unattached to said hood top comprises a fold line and at least part of said portion between said leading fold line and said trailing fold line unattached to said hood top forms an angle about said fold line.

14. The process according to claim 1, wherein said die comprises one or more vent holes within said die recess.

15. A process for packaging a product comprising the steps of:

manufacturing the product, wherein said product is a substrate treatment composition;

providing a tray carriage system;

providing a tray movable in or on said tray carriage system;

moving said tray via said tray carriage system in a machine direction MD;

providing a dispensing system above said tray carriage system;

dispensing said product into said tray via said dispensing system;

providing a hood engagement system above said tray carriage system and downstream of said dispensing system;

providing a hood moveable in said hood engagement system, wherein said hood is erected by a process comprising the steps of:

providing a flat blank comprising a leading panel, a trailing panel opposite said leading panel, a hood top extending between said leading panel and said trailing panel, a leading fold line between said leading panel and said hood top, a trailing fold line between said trailing panel and said hood top;

providing a flat insert adhered to a panel selected from the group of said leading panel, said trailing panel, and combinations thereof, wherein said flat insert has a portion between said leading fold line and said trailing fold line unattached to said hood top;

providing a die comprising a leading edge and trailing edge, a pair of side edges extending from said leading edge to said trailing edge, and a die recess, wherein said die recess is recessed relative to said leading edge, said trailing edge, and said side edges;

providing hood mold having a cavity;

orienting said flat insert towards said die recess; and positioning said die within said hood mold to fold said flat blank about said leading fold line and said trailing fold line and to fold said flat insert coincidentally with at least one of said leading fold line and said trailing fold line, whereby said portion between said leading fold line and said trailing fold line unattached to said hood top is spaced apart from said hood top; and engaging said hood with said tray via said hood engagement system to fit said insert within said tray and close said tray to form a closed package.

16. The process according to claim 15, wherein said die is pressed into said hood mold.

17. The process according to claim 15, wherein said flat insert comprises a fold line parallel to said leading fold line and said trailing fold line.

18. The process according to claim 15, wherein said die comprises a pair of flat insert seating areas, one of said flat insert seating areas between said leading edge and said die recess and another said flat insert seating area between said trailing edge and said die recess.

19. The process according to claim 18, wherein said flat insert seating areas are recessed relative to said side edges, wherein said flat insert seating areas are sized and dimensioned to accommodate portions of said flat insert that extend beyond said die recess.

* * * * *